United States Patent [19]

Beidl et al.

[11] 4,242,680

[45] Dec. 30, 1980

[54] MULTIPLE DATA LINE SHIFT GAS PANEL ASSEMBLY

[75] Inventors: John R. Beidl, Red Hook; Tony N. Criscimagna; James C. Greeson, Jr., both of Woodstock, all of N.Y.

[73] Assignee: International Business Machines Corporation, Armonk, N.Y.

[21] Appl. No.: 881,450

[22] Filed: Feb. 27, 1978

[51] Int. Cl.[3] ..... G09F 9/313

[52] U.S. Cl. ..... 340/771; 313/217; 315/169.4; 340/752

[58] Field of Search ..... 340/324 R, 324 M, 771, 340/779; 315/169 TV; 313/217

[56] References Cited

U.S. PATENT DOCUMENTS

| | | | |
|---|---|---|---|
| 3,795,908 | 3/1974 | McDowell et al. | 340/324 M |
| 3,942,060 | 3/1976 | Harvey | 313/217 |
| 3,981,001 | 9/1976 | Ogle | 340/769 |
| 4,081,717 | 3/1978 | Kaji et al. | 315/169 TV |

OTHER PUBLICATIONS

Weikart, "Independent Subsection Shift and a New Simplified Write Technique for Self-Shift AC Plasma Panels", IEEE Transactions on Electron Devices, vol. ED-22, No. 9, Sep. 1975, pp. 663-668.

*Primary Examiner*—David L. Trafton
*Attorney, Agent, or Firm*—Joseph J. Connerton

[57] ABSTRACT

A plasma panel arrangement for storing, displaying and selectively shifting information from one place therein to another includes a panel filled with an illuminable gas, and horizontal and vertical parallel conductor arrays disposed on opposite sides of the panel, the coordinate intersections of the conductors defining gaseous discharge cells. The vertical conductors are sequentially driven by a multi-phase drive system, and the panel includes a plurality of data lines for entering information. The data as entered is sequentially shifted left or right in a horizontal direction in a single line display. In a multi-row display, the system provides left or right shifting of one character row while holding the display of the other character rows. The instant invention makes the plasma shift technology competitive in speed to X-Y matrix addressed panels, but at a much reduced circuit cost.

15 Claims, 6 Drawing Figures

MULTIPLE DATA LINE SHIFT GAS PANEL ASSEMBLY

BACKGROUND OF THE INVENTION

The invention relates to gas panels and more particularly to such devices where information stored and displayed therein may be shifted horizontally or vertically in a single row or multi-row display.

Gas panels using conventional X-Y matrix addressing are expensive to implement, since they conventionally require individual drivers for each horizontal and for each vertical line. Using an 80 character single row display with 7×9 character dot matrix, addressing would require 560 vertical drivers, to activate selected vertical conductors to ionize the gas at selected coordinate intersections. One alternative to X-Y matrix addressed panels known in the art is the shift gas panel, one example of which is shown in U.S. Pat. No. 3,795,908 "Gas Panel with Multi-Directional Shifting Arrangement" issued to Allen W. McDowell and Frank M. Lay and assigned to the assignee of the instant invention. Such shift systems employ a three or more phase sequential drive arrangement whereby only three or more vertical drivers are required for the entire panel. Data is entered on one end of the panel and sequentially shifted in any direction until the entire message is displayed. While providing substantial cost savings in drive circuitry, such panels are generally limited in character capacity, since the entire display must be updated at a high repetition rate to prevent dimming. The term dimming refers to a visual distraction presented during character entry or update by characters entering the display at a speed slow enough to be noted but not followed by the eye. Typically such speed could be 70 inches per second. Thus heretofore in the art, shift gas panels have been generally relegated to the low end high aspect ratio displays. There is a need therefore to increase the speed and eliminate the phenomenon of the shift gas panel, and it is toward a solution of these problems that the present invention is directed.

SUMMARY OF THE INVENTION

In conventional a.c. plasma shift panels, data is entered on one side of the display through a data entry line and then shifted sequentially to its appropriate location for display. The present invention utilizes multiple data entry lines distributed throughout the panel whereby a physical gas panel is effectively operated as a plurality of smaller electrically interconnected shift gas panels with common horizontal lines and phase drivers. The update speed is effectively although not directly related to the number of data entry lines, so that the update time can be designed or tuned for a specific display to eliminate the dimming problem. The data entry lines, hereinafter designated D lines, extend the length of the vertical lines to serve as inputs for all display lines, and are formed as part of the panel conductor pattern. A single driver can accomodate multiple data entry lines, but individual horizontal selection circuitry adapted for integrated circuit packaging in modules is employed for selective write or erase functions. By operating in this mode, a shift panel fabricated by conventional gas panel fabrication techniques can be designed and the speed tailored to the specific display requirements. The ultimate speed of the present invention would be provided by one data entry line per character, but such high speed is generally not necessary. A specific embodiment of the present invention describing all related physical and electrical parameters will be shown and fully described hereinafter.

Accordingly, a primary object of the present invention is to provide an improved shift gas panel structure having multiple data entry lines.

Another object of the present invention is to provide a multiple data line gaseous discharge shift panel display assembly.

Another object of the present invention is to provide a high speed gaseous discharge shift panel display adapted for high speed driving with low cost circuitry.

Another object of the present invention is to provide a multiple row gaseous discharge shift panel adapted while manipulating data in one display row to hold the remaining lines without adverse dimming effects.

DESCRIPTION OF THE PREFERRED EMBODIMENT

Figure 1:
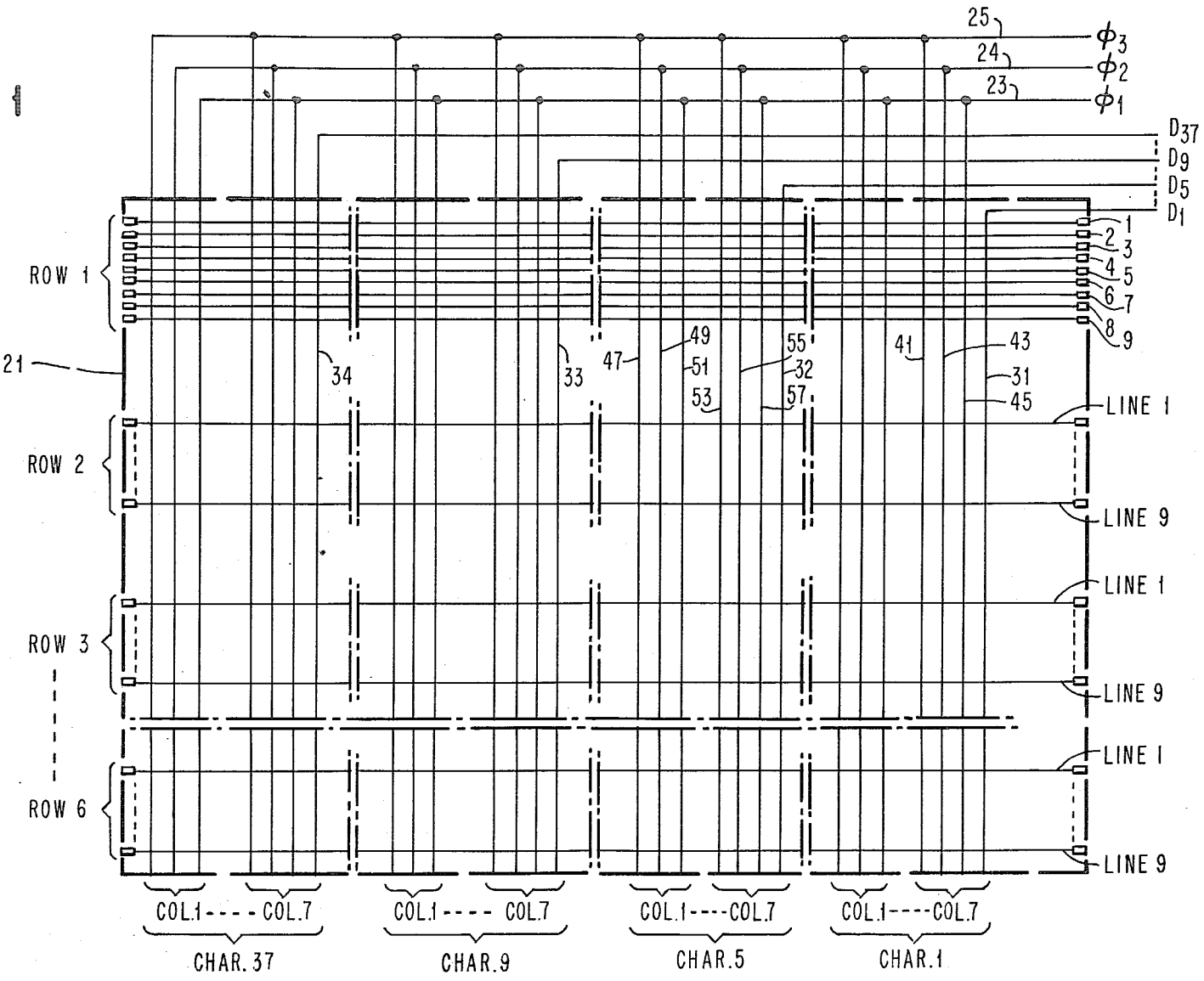
FIG. 1 is a schematic view of the conductor geometry of the instant invention.

Before proceeding with the description of the details of the preferred embodiment, certain general characteristics as well as details of and operation of plasma shift panels will be briefly described. The fabrication of a.c. X-Y matrix gaseous discharge display devices is known in the art, one example being shown in U.S. Pat. No. 3,837,724 "Gas Panel Fabrication" filed by Peter H. Haberland et al and assigned to the assignee of the instant invention. The details of gas panel fabrication utilized in the a.c. X-Y addressable panels may be substantially identical to those used in the fabrication of the high resolution shift panel of the instant invention, since the additional data lines may be formed as part of the conductor deposition. The preferred embodiment of the instant invention will be described in terms of a 240 character panel comprising six rows of forty characters per row, each character being generated on a 7×9 dot matrix. To provide increased light intensity, each dot in the 7×9 character matrix utilizes two of the three vertical conductors during display, $\phi 2$ and $\phi 3$ being sustained, while $\phi 1$ is erased. The sustain frequency of the preferred embodiment of the shift panel is 50 KHZ, while the picture element (PEL) or line resolution of the panel is 50 PEL's per inch, each PEL designating the distance between adjacent identical phase lines. The terms "sustain" and "shift" in the instant invention are used interchangeably and identify the same signal source of 50 KHZ. The shift speed is 300 microseconds per PEL.

Finally, there is a problem in a.c. plasma shift panels of initiating and sustaining a discharge using only a single drive or sustain signal respectively. To overcome this problem and ensure satisfactory operation, the drive circuit of the instant invention is operated in a burst mode in which a burst of sustain cycles is used for sustain or shift, with a multi-cycle overlap of adjacent phases during the shift sequence to provide enhanced coupling during the shift operation. The term "burst" refers to the number of sustain cycles applied to a phase line during the SHIFT operation. The term "overlap" is the number of sustain cycles during which two adjacent phases are simultaneously sustaining on the shift sequence. In a three phase shift system as utilized in the instant invention, OVERLAP must not exceed [(BURST/2)−1] if directionality is to be maintained. Without using the instant invention, each character row of the above described preferred embodiment using a single D line would have a normal update time of 108 milliseconds, at which speed the entry of data into the panel by shifting, i.e., the dimming effect, is visible to the viewer. As previously noted, the update time of a shift panel using the multiple data line concept varies inversely as the number of data entry lines, and the dimming effect of data entry into the panel will not be visible at higher speed, resulting from an appropriate selection of the number of D (data entry) lines. In the preferred embodiment of the invention herein described, ten data entry lines are utilized for 40 characters, or one data line per four characters. The update time and other electrical parameters of the preferred embodiment are described in greater detail hereinafter.

Referring now to the drawings and more particularly to FIG. 1 thereof, there is illustrated in schematic form the geometric configuration of the drive pattern for the above described preferred embodiment of a 240 character display, six rows of 40 characters per row, utilizing a 7×9 character matrix. The specific conductor interconnection pattern including crossover has been omitted as beyond the scope of and unnecessary for an understanding of the present invention. While the instant invention would afford maximum economy in the highest aspect ratio display (single line), there are additional features of the instant invention directed specifically to a multiple line display. A three phase (3$\phi$) driving source comprising $\phi$1, $\phi$2 and $\phi$3 signals are applied from a three phase buss to the vertical panel lines sequentially via lines 23, 24, and 25 respectively. As more fully described in greater detail hereinafter, the sustain signals in burst mode are used both to sustain the non-selected rows and to shift the characters in the selected row in a horizontal direction. It will be appreciated that the instant invention is also applicable to shift in the vertical direction, but is described in terms of horizontal shifting merely by way of example. To further illustrate the operation of the invention herein described, data will be assumed to be entered from the right and shifted to the left, although this also is merely a matter of design choice and the invention is equally applicable in a horizontal right shift mode.

As heretofore indicated, a separate data entry line is used for each four characters so data entry lines 31, 32, 33 and 40 are associated with characters 1, 5, 9, and 37 respectively and function with their associated group of four characters. In the interest of clarity, only columns one and seven of individual character are shown in the drawings, each column comprising $\phi$1, $\phi$2, $\phi$3 lines, since the character resolution, as heretofore described, is 50 PELs per inch. Character entry is accomplished from the D lines on a sequential vertical slice basis, each slice comprising nine bits of the 7×9 dot matrix character. The data entry lines are synchronized with the $\phi$3 shift signal on line 25, and depending on the row selected, the associated horizontal lines will be activated to cause a select or write signal to be entered in the associated lines having a binary one address, and a non-select horizontal signals to be applied to those lines having a binary zero address. It is apparent that the entire D line is actuated, and that selection is provided by the associated horizontal conductors.

The individual shift signals, as described supra, are utilized in a sequence of an eight pulse burst with a three pulse overlap between adjacent phases so that at the sixth pulse interval of $\phi$1, $\phi$2 is initiated, and similarly $\phi$3 is initiated at the sixth pulse interval of phase 2 and the sequence is repeated for each data slice entered in the selected row until the entire row is completed. The common three pulse interval during which $\phi$2 and $\phi$3 overlap is used as the sustain or hold time for the non-selected rows. As noted above for a three phase shift system, OVERLAP must not exceed (BURST/2 −1) if directionality is to be maintained. Maximum shift speed can be obtained by shortening the BURST time and maintaining the OVERLAP at the maximum value permitted by the panel and erase waveform characteristics. The burst of 8 and overlap of 3 provide a shift sequence time of 300 microseconds with a 50 KHZ sustain frequency, which in turn allows a 7×9 character row to be shifted in 2.7 milliseconds and a full character row update of 360 shifts in 108 milliseconds. It is noted that the full shift or update sequence includes the 7 character positions and the two positions between characters for a total of 360 shift positions per 40 character row. Vertical drive lines 35, 37 and 39 depict the first vertical slice of character one, while lines 41, 43 and 45 depict the seventh column of character one using the 7×9 dot matrix previously designated. Similarly, lines 47, 49 and 51 are associated with column 1 of character 5 while lines 53, 55, and 57 are associated with column 7 of character 5 and so forth. Thus in the interest of clarity, only two of the seven vertical slices are illustrated for each of the four characters in each row, and only one of the four characters in the specified groups are shown in the drawing. As depicted in the drawing, each of the six rows has nine horizontal lines associated therewith lines 1 through 9 being shown in row 1 as terminating thereon. For maximum flexibility, the horizontal row conductors are shown as terminated on opposite edges of the panel. The data entry or D lines 31, 32, 33, 40 have drive circuits associated with each individual line which will apply a write, erase or sustain signal on a non-selective basis to the line, in accordance with whether the selected function, while selection is provided by the horizontal lines on a slice basis according to whether the bit address identifies a one or a zero respectively.

The invention herein described utilizes the full select signal technique in which a full select signal of 80 volts, for example, will be applied to the selected line and a zero voltage applied to the non-selected line. Such systems are known in the art and described, for example, in application Ser. No. 729,056 filed by William R. Lamoreux and James B. Trushell Oct. 10, 1976 now U.S. Pat. No. 4,097,856. Details of writing will be more fully described hereinafter with reference to FIGS. 2 through 4 respectively. As each column of the character is written into the selected D line or in the preferred embodiment ten D lines, a fifteen pulse sequence is generated to shift the data from the D line into the corresponding adjacent character column, so that after nine such sequences, 10 complete 7×9 characters and 2 spaces per character have been entered and shifted into position immediately adjacent to the data entry position. A two space interval is provided between characters, at which time the second set of ten characters is processed and so forth . After four characters have been entered into each ten groupings for a total of 40 characters on a row, information will be written sequentially into the next row while the information in the first or remaining rows in sustained, and the identical operation repeated until all data has been entered into the six rows for the complete display of 240 characters. Again for purposes of clarity, only four rows have been shown in the configuration in FIG. 1.

The formula by which update time is increased is a factor of the number of data entry lines which will be described in detail hereinafter, but it approximates 1/D, where D is the number of data entry lines, so the update time of the preferred embodiment of the instant invention, using 10 D lines, is increased by a factor of approximately ten.

Finally, the erase operation should be noted. Normally, when a message has been entered on the display, the sustain signal is applied to both $\phi$2 and $\phi$3 lines to increase the display intensity, while an erase signal is applied from the vertical $\phi$1 driver to maintain the $\phi$1 line in the off condition during the display sequence. Normally, an erase operation will not be utilized since new information can be entered into the display to replace existing information which is shifted out of the opposite end thereof. Because of the non-addressable nature of the shift character panel, selective erase is not provided but only bulk erase on a row or on an entire message basis. The only way a picture element can be erased is to shift it off the end of the panel. However, in the case of partial messages or messages which will begin with the sequence of blanks, the existing information would have to be erased prior to entry of new information. The erase signal is associated with the phase drivers such that the erase waveforms emanating from the vertical phase drivers are common to the entire panel, so the normal mode of operation is a complete panel erase. However, by suitable control of the horizontal row driver circuitry, single row erase can be provided. By interchanging the drive signals applied to the $\phi$2 and $\phi$3 drivers at the proper time, the shift direction can be altered from left to right. Additional details of the erase circuitry, including the erase waveform and its relationship to the burst and overlap will be described hereinafter in greater detail with respect to FIGS. 3 and 4A,4B.

Figure 2A:
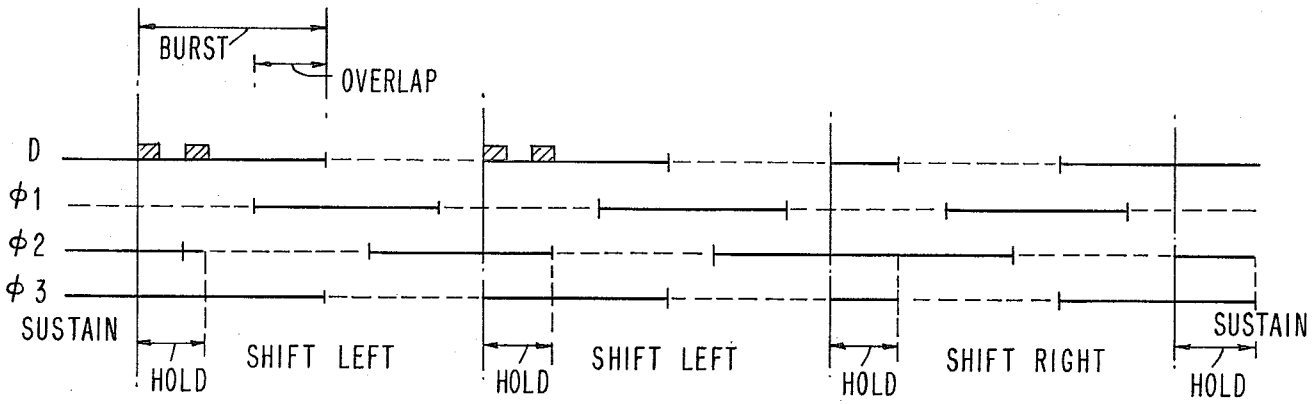
FIGS. 2A and 2B illustrate the timing relationship between the drive and shift operations of the instant invention.
Figure 2B:
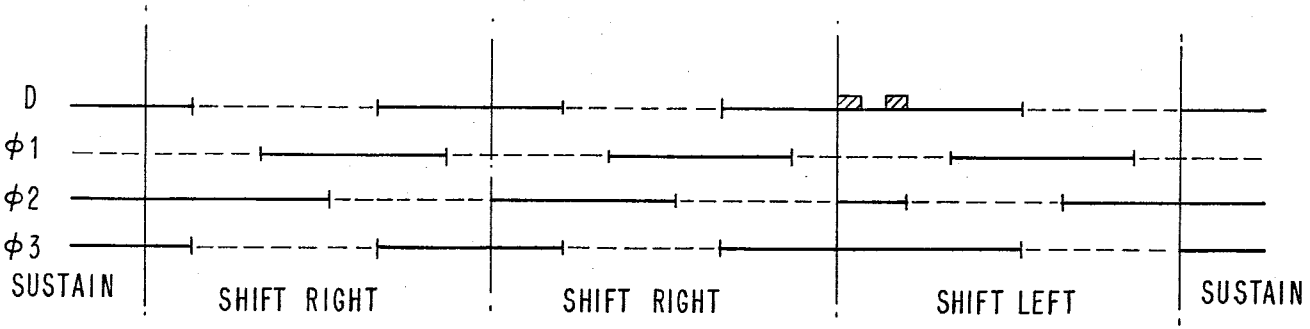

Referring now to FIGS. 2A,2B, there is illustrated a timing diagram of the write, sustain and shift operations of the instant invention. Initially, it should be noted that the number and sequence of operations shown in FIGS. 2A,2B bears no relationship to the operation of the preferred embodiment of the instant invention, but is merely used to illustrate specific operations. Any of the sequence (write, sustain, shift left, shift right) may be preceded or followed by any of the other sequences. The shift sequence required to shift data one PEL position, i.e., from one display position to the corresponding adjacent display position, comprises fifteen sustain cycles. It should be noted that the four lines illustrated in FIGS. 2A and 2B, the D line and $\phi$1, $\phi$2 and $\phi$3 lines, are normally in the sustain or erase mode except that the D line may be modified by adding a write waveform to it during the write operation and hence is the only line that can actually write data into the panel.

FIG. 2A illustrates initially a phase shifting sequence in which one slice of data is shifted one PEL position. The sustain margin of the shift panel is affected by the number of sustain alternations applied to a phase during the shift operation, as well as the number of sustain alternations when two adjacent phases are simultaneously sustained. The burst sequence, as shown, is eight sustain cycles with a three cycle overlap, so that the entire shifting sequence required to shift one slice of data one picture element position is 15 cycles. The HOLD sequence which is a modified form of sustain applied to the non-selected rows during operation in the selected row occurs during the overlap of the $\phi$2 and $\phi$3 signals. Reversing the drive applied to the $\phi$2 and $\phi$3 lines, as previously described, can cause the shift direction to be reversed and applied in the opposite direction or a shift right operation as shown in the third sequence of the FIG. 2A waveforms. A complete shift of the character 1 position to the right would require 9 shift right sequences, and no data would be indicated on the D (data entry) line. In FIGS. 2A and 2B, the solid lines indicate the $\phi$1, $\phi$2, $\phi$3 sustain, the dotted lines indicate phase erasing while the pulses on the D lines indicate a write sequence of two cycles.

FIG. 2B illustrates two shift right sequences by way of example, nine of which (seven character slices and a two line space) are required for a complete one character shift. Replacement data could then be entered by a shift left in the conventional manner as indicated in the third sequence of FIG. 2B. Thus nine shift sequences, each comprising in turn 15 sustain or erase cycles, are required to enter or remove data from the panel. It should be noted that the instant invention would probably not be utilized in any operation where editing would constitute a significant portion of the workload. The burst sequence used in the shifting operations are used to enable the selected cells to reach their stable "on" state, while the overlap is used to enhance coupling between adjacent conductors during the shift operation. Also, the D line is driven in time coincidence with the $\phi$3 line. When information has been positioned through the shift operation, $\phi$2 and $\phi$3 lines are maintained in the "on" condition to increase the brightness to the desired level. When operated in this manner and at the above specified frequencies, there is no apparent dimming effect, and insofar as the observer is concerned, all data appears instantaneously on the panel in the same manner as an X-Y addressed matrix panel rather than appearing to shift in from either direction.

Figure 3:
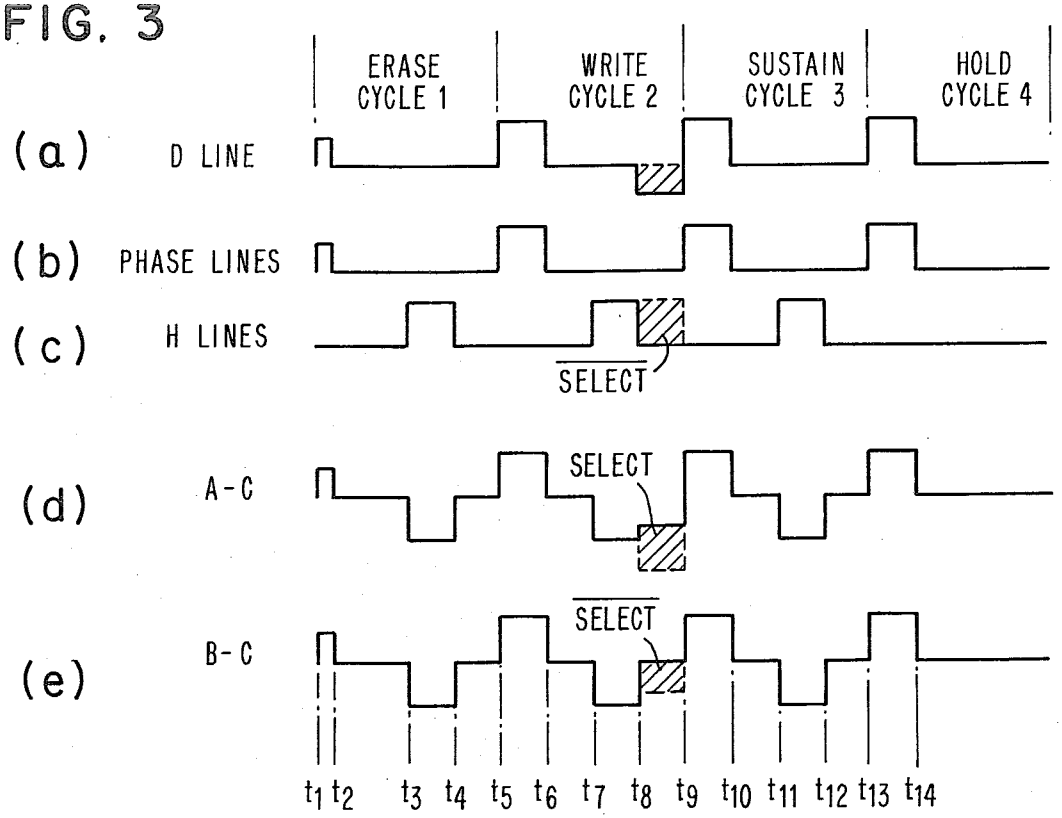
FIG. 3, waveforms (a)-(e) illustrates the waveforms of the signals used for the drive and shift operations of the instant invention.

Referring now to FIG. 3, there is illustrated a family of waveforms used to provide the erase, write, sustain and hold functions in the instant invention. As previously described, the D line, shown in waveform (a), can have erase, write and sustain signals applied thereto and will normally be in the erase, write or sustain mode. Operated at a frequency 50 Kilohertz, the erase waveform has a strong effect on the operating margin of the panel, i.e. $V_s$max–$V_s$min., in the illustrated embodiment a 9 volt margin, such that the adjustment of the erase waveform is critical. A high amplitude erase produces stronger coupling in the shift operation lowering the $V_s$ max., while a low amplitude erase weakens the coupling raising the $V_s$ min. each operation, both signals tending to reduce the sustain margin. A low amplitude erase allows operation at the higher sustain levels, while the overlap, when maintained at 3 cycles, provides the high coupling provided by the high amplitude erase waveform. Thus, there is a correlation between the shape of the erase pulse, the coupling between adjacent conductors, and the overlap.

The erase waveform shown in waveform (a) of FIG. 3 and used in the present invention has 2 characteristics, a high amplitude leading edge to enhance coupling and a proper width to erase. Properly adjusted, this erase waveform reduces the required burst and overlap time, and at a frequency of 50 Kilohertz, produces the best shift margin. The erase pulse shape shown in waveform (a) of FIG. 3 decreases the panel update time with only a small loss in shift margin. It should be noted that the sequences of erase, write and sustain, as shown in FIG. 3, apply to the selected row into which data is being entered or removed, while the hold operation is essentially directed to sustain the remaining non-selected rows.

In the erase operation, an erase signal is generated on the D line as shown in waveform 3(a) and on the phase lines as shown in waveform 3(b). The horizontal lines H are maintained at ground reference during $t_1$–$t_3$ of the first cycle, while a positive pulse is generated between $t_3$–$t_4$ of cycle 1. The composite of waveforms (a–c) and (b–c) shown in waveforms d and e of FIG. 3 respectively are erase pulses having the above described characteristics.

In the normal write sequence, a full write amplitude pulse is applied to the D line at time $t_8$. The normal horizontal sustain signal between $t_7$ and $t_8$ is extended to $t_9$ to generate the select waveform shown in waveform 3(*c*) while the non-select ($\overline{\text{SELECT}}$) line remains at the lower level shown at time $t_8$–$t_9$. When the write pulse is applied, the cells at the intersection of the D line and the selected horizontal line will be written by the composite signal shown at time $t_8$–$t_9$ of waveform 3*d*. Thus firing will occur at the intersection of the D line and the selected horizontal line, while firing will not occur at the intersection of the D line and the deselect ($\overline{\text{SELECT}}$) horizontal line shown in waveform 3(*d*). During a sustain sequence, as shown by the sustain cycle 3, between $t_9$–$t_{13}$, the cells that are on $\phi$2 or $\phi$3 line are sustained. While the D lines receive the sustain signal shown in waveform 3*a*, the horizontal lines of the selected row will receive the sustain signal shown in waveform 3(*c*). The composite sustain signals provided between the D line and the selected horizontal line are shown in waveform 3*d*, while the composite between the phase lines and the horizontal lines are shown in waveform 3*e*, the identical waveform being used for the sustain function.

When shifting occurs, rows that are not to be shifted are held stationary by not pulsing their bulk pull-up transistors, and the cells on the non-selected rows receive the composite hold signal shown in hold cycle 4, waveforms d and e of FIG. 3. Since the peak to peak voltage applied to the stationary or non-shifted character rows is not sufficient to cause an avalanche, the cells on these character rows do not fire. However, due to the inherent memory characteristic of an a.c. plasma panel, the data previously contained in the stationary character rows will reappear when a normal sustain waveform is again applied at the frequency of operation described relative to the preferred embodiment. However, insofar as the eye is concerned, the display remains on the screen of the panel. The selected rows have their bulk pull-up transistors pulsed normally, and the composite waveform will depend upon the time in the shift sequence. Not shown in either FIG. 1 or in the waveforms of FIG. 3, a pilot operation is used to facilitate panel operation in which a pilot light or lights beyond the viewing surface of the panel will be fired to provide a source of metastables to initiate panel operation. The pilot operation is considered known in the art, and is described, for example, in U.S. Pat. No. 3,609,658 issued to Parvis Soltan on Sept. 28, 1971.

Figure 4A:
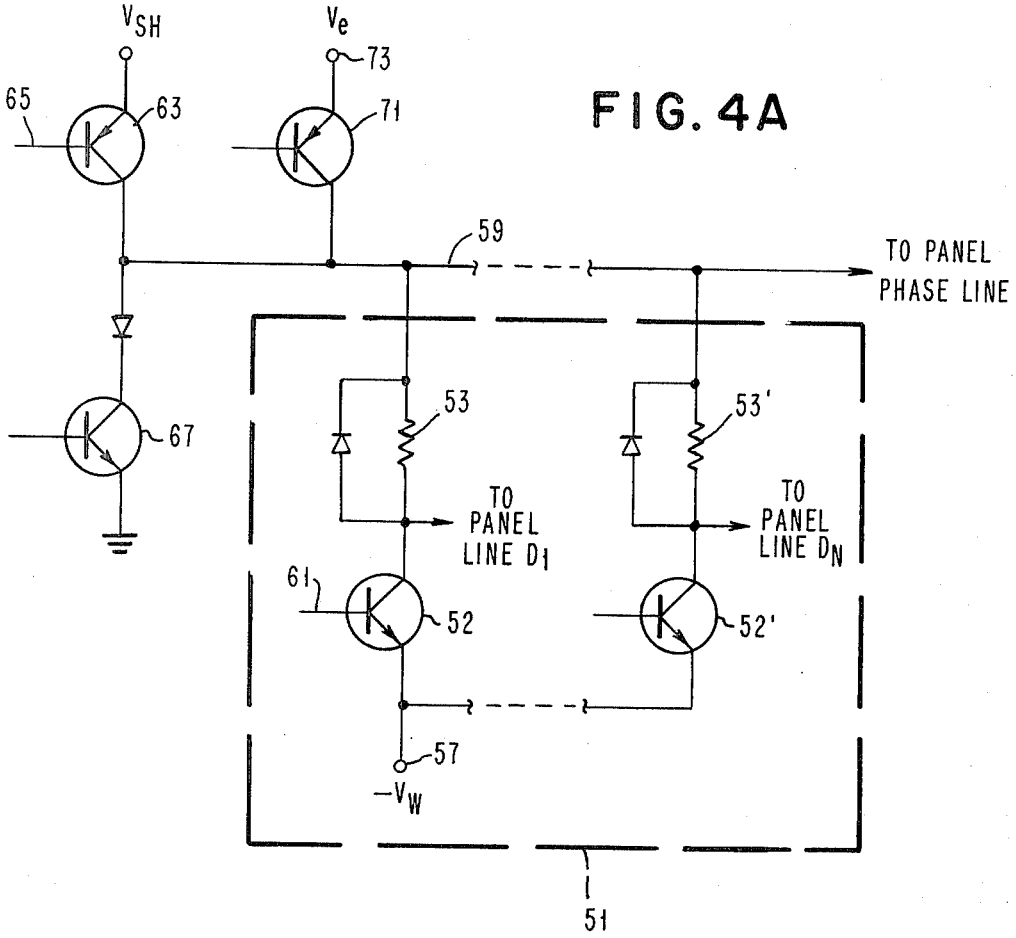
FIG. 4A and 4B illustrates circuit schematics of the drive and shift circuits utilized in the instant invention.
Figure 4B:
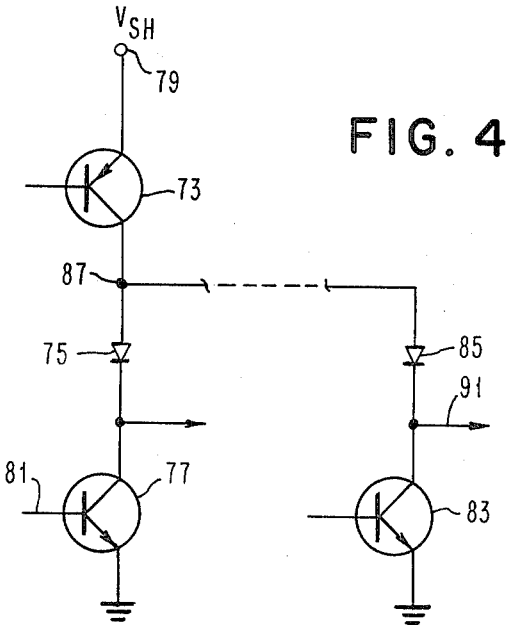

Referring now to FIGS. 4A and 4B, there is illustrated the horizontal and vertical drive circuits required to provide multiple data entry and the sustain, write and erase operations associated therewith. These operations are accomplished by applying the associated waveforms for the respective operations on the $\phi$ drivers, D lines and associated horizontal conductors. Referring initially to FIG. 4A, the circuit shown therein is a simplified vertical drive circuit, three of which are required since the D lines share the $\phi$3 drive. The circuitry required by the D line for writing is shown within block 51. The remaining circuitry in FIG. 4A is for the erase, sustain and hold function for the 3$\phi$ vertical shift lines. PNP transistor 63 will drive a selected phase line to the shift power supply voltage, $V_{SH}$, while NPN transistor 67 will drive a selected phase line to the ground level, transistors 66 and 67 being controlled by logic signals applied to the bases through input lines 65, 66 respectively. A sustain function is applied to the shift line as illustrated in the sustain cycle of FIG. 3 by alternately turning devices 67 and 63 on. PNP transistor 71 is used for applying an erase signal which is less than the shift potential to the associated shift line 59. An erase cycle is created by alternately turning devices 71 and 67 on. The D lines share a set of shift transistors with the $\phi$3 line so that for individual D lines, the additional circuitry required consists of a transistor 52, a resistor 53 and a diode 55. The non-select operations, hold or shift, are coupled to the D line either through resistor 53 in the case of $V_E$ or $V_{SH}$, or through diode 55 in the case of ground. During the selective write operation which commenced at time $t_8$ in FIG. 3, a selected D line will have device 52 on pulling the D line to the write level $-V_W$ as illustrated in waveform (a) of FIG. 3; non-selected D lines are held at the ground via resistor 53 and diode 55. In the preferred embodiment using 10 D lines, there are ten circuits comprising transistors 52, resistors 53, diodes 55 as illustrated in block 51 of FIG. 4A.

Since three vertical drive lines are used for each picture element, three of the vertical drive circuits such as shown in FIG. 4A are required for a shift sequence. During a sustain sequence, the cells on the $\phi$2 or $\phi$3 lines receive the composite voltage such as shown in cycle 3 of FIGS. 3*d* and 3*e* respectively, times $t_9$–$t_{13}$, while the cells on the $\phi$1 lines will receive an erase sequence such as shown in cycle 1, times $t_1$–$t_5$, of FIGS. 3*d* and 3*e*. When shifting occurs, rows that are not to be shifted, i.e., the non-selected rows, are held stationary by not pulsing their bulk pull-up transistors. The cells on these rows receive a composite hold voltage shown in waveforms *d* and *e* of FIG. 3 at times $t_{13}$–$t_{14}$. Since the peak to peak voltage applied to the stationary character rows is not sufficient to cause an avalanche, the cells on these character rows do not fire. However, because of the inherent memory characteristic of an a.c. plasma planel, the data previously contained in the stationary character rows will reappear when a normal sustain waveform is again applied. The selected rows have their bulk pull-up transistors pulsed normally as above described, and the composite waveform will be a function of the time in the shift sequence.

The horizontal drive circuitry can be relatively simple, and, as shown in FIG. 4B, includes common row circuitry and circuitry for individual lines within the row. The row circuitry includes interface circuitry includng a pull-up transistor 73 designated the bulk transistor connected between the $V_{SH}$ shift voltage source and junction 81. Transistor 73 is a PNP transistor which is controlled by a negative transition signal applied to input line 80 when the associated row is being manipulated in a sustain, write or erase mode to enter or erase data. Each line within the row is adapted for selective pull-down and includes an individual pull-down circuit comprising an isolation diode and an NPN transistor connected between the junction 87 and ground. Select lines are maintained up, deselect lines pulled down. Thus diodes 75, 85 and transistors 77, 83 are operated by positive transition control signals to control lines 1 and 9 of the selected row respectively. The circuit configuration shown in FIG. 4B will be repeated for each row of the display, six in the preferred embodiment.

The above described circuitry except for power transistor circuits 63, 67, 71 is susceptible to dense integrated circuitry packaging, thus providing a low cost, low power drive.

As an indication of the change in update times provided by the instant invention, the update speed of the panel is determined in accordance with the formulas $[20(D-1)+300]$ microseconds, where D is the number of data entry (D) lines in the panel and S is the number of picture element slices between D lines, 36 in the preferred embodiment described above. In a conventional plasma shift panel having a line count of 40 characters as described in the preferred embodiment of the instant invention, a total of 300 microseconds is required to shift one byte of data one PEL position. Utilizing the parameters previously described with respect to the preferred embodiment but having a single D line, an update time of 108 milliseconds is required to update one complete row of data, while with the preferred embodiment of the invention, only 17.28 milliseconds is required. The instant invention provides a high resolution plasma shift panel with practical physical parameters which can be fabricated using conventional gas panel manufacturing techniques, operates at higher shift speeds and features independent right or left shifting of one character row while holding the other character rows. The shift panel drive system herein described thus makes shift technology competitive in speed to X-Y matrix addressing panels but at a much reduced circuit cost. The preferred embodiment provides a bright display having large picture elements, economy in electronics particularly when packaged in integrated circuits, high shift speed, and individually addressed row shifting in either direction and good operating margins. The multiple data entry panel is a hybrid shift panel in which the number of D lines can be modified up to a maximum of one per character position. The operating speed approaches that of an X-Y address panel, while the electronics would be only slightly more expensive than that of the conventional plasma shift panel as shown and described relative to FIGS. 4A and 4B. The high update speed afforded by the instant invention completely eliminates any noticeable dimming during data entry. Thus the invention provides an a.c. plasma display panel with the speed of an X-Y address panel combined with the low cost of a plasma shift panel.

While the invention has been shortly described with respect to a preferred embodiment thereof, it will be understood that various changes in form and detail may be made by those skilled in the art without departing from the spirit and scope of the invention. Accordingly, the plasma shift panel is considered to be merely illustrative of the invention, and the scope of the invention is to be limited only as specified in the claims.

Having thus described our invention, what we claim as new, and desire to secure by Letters Patent is:

1. A system for selective manipulation of information for display in a gaseous discharge display device comprising in combination a gaseous discharge device adapted for operation in a shifting mode, a multi-phase drive source for driving said panel, first and second sealed glass plates filled with an ionizable gas, each of said glass plates having an array of conductors formed thereon, the conductors on one of said arrays on said first plate being disposed substantially orthogonal to the conductors on the other of said arrays on said second plate, the respective intersections of said orthogonally disposed conductors defining gaseous discharge sites, the number of conductors on said first plate comprising an integer which is a multiple of the number of phases in said multi-phase drive source, multiple data entry means associated with said first plate, said multiple data entry means including means for simultaneously entering data into different pre-determined positions on said display device, and means for decreasing the update time of said panel by simultaneously operating said multiple data input means.

2. A device of the character claimed in claim 1 wherein said multiple data entry means includes a plurality of data lines interspersed between character matrix positions of said first plate.

3. A device of the character claimed in claim 2 wherein data is shifted between data entry lines in response to said multi-phase drive source.

4. Apparatus of the type claimed in claim 3 wherein said data entry lines defined boundaries for selective shifting of data within said boundaries.

5. Apparatus of the type claimed in claim 4 wherein said data entry lines are driven in synchronism with one of the phases of said multiphase drivers.

6. Apparatus of the type claimed in claim 5 wherein said display comprises a plurality of display rows formed by horizontal conductors on said second plate and wherein said selective manipulation of information comprises sustain, write, and erase operations.

7. Apparatus of the type claimed in claim 6 wherein said selective manipulation of data includes means for operating in one of said rows while simultaneously sustaining the remaining rows in said display.

8. Apparatus of the type claimed in claim 7 wherein said write operation required coincident driving of said horizontal lines and associated data entry lines.

9. Apparatus of the type claimed in claim 7 adapted for slice writing in which the selective energization of said horizontal lines and said associated data entry line causes a byte of data corresponding to one slice of the character to be entered into said display.

10. Apparatus of the type claimed in claim 9 wherein said data slice is shifted by said multiphase drive source to the adjacent picture element area to permit entry of subsequent data.

11. Apparatus of the type claimed in claim 7 wherein said sustain and shift functions are provided by a common drive source.

12. Apparatus of the type claimed in claim 10 wherein the intensity of said display is increased by simultaneously energizing the cells positioned between adjacent drive lines and selected horizontal lines.

13. A gaseous discharge display assembly adapted to operate in a shifting mode comprising in combination, first and second glass plates, said plates being sealed and filled with an ionizable gas, conductor arrays disposed on each of said plates, said conductor arrays being substantially orthogonal with respect to each other, the conductor array on said first plate comprising groups of lines for displaying and shifting data, a multi-phase shifting source for shifting said data, and a plurality of data entry means for simultaneously writing data into multiple areas in said panel, said data entry means being disposed at predetermined positions within said panel to facilitate data entry and update time whereby the dimming effect of data entry is substantially eliminated, said plurality of data entry means comprising individual lines defining boundary locations on said first plate for establishing individually controlled display areas for shifting and displaying data therein.

14. A device of the character claimed in claim 13 wherein the conductor array on said second plate comprises a number of conductors equal to at least one row of a predetermined display format.

15. Apparatus of the type claimed in claim 14 wherein writing, erasing or sustaining data requires coincident selection of horizontal lines and associated data lines.

* * * * *